US011168930B2

(12) United States Patent
Mogi et al.

(10) Patent No.: US 11,168,930 B2
(45) Date of Patent: Nov. 9, 2021

(54) EXPANSION VALVE

(71) Applicant: Fujikoki Corporation, Tokyo (JP)

(72) Inventors: Takashi Mogi, Tokyo (JP); Kouhei Kubota, Tokyo (JP); Ryo Matsuda, Tokyo (JP); Shin Honda, Kariya (JP); Kurato Yamasaki, Kariya (JP); Shigeki Ito, Kariya (JP)

(73) Assignee: FUJIKOKI CORPORATION, Tokyo (JP)

( * ) Notice: Subject to any disclaimer, the term of this patent is extended or adjusted under 35 U.S.C. 154(b) by 1 day.

(21) Appl. No.: 16/633,499

(22) PCT Filed: Jun. 1, 2018

(86) PCT No.: PCT/JP2018/021174
§ 371 (c)(1),
(2) Date: Jan. 23, 2020

(87) PCT Pub. No.: WO2019/039030
PCT Pub. Date: Feb. 28, 2019

(65) Prior Publication Data

US 2020/0208888 A1 Jul. 2, 2020

(30) Foreign Application Priority Data

Aug. 23, 2017 (JP) ..... JP2017-160032

(51) Int. Cl.
*F25B 41/31* (2021.01)

(52) U.S. Cl.
CPC ..... *F25B 41/31* (2021.01); *F25B 2500/13* (2013.01)

(58) Field of Classification Search
CPC ..... F25B 2341/06; F25B 2341/062; F25B 2341/063; F25B 41/31; F25B 41/34;
(Continued)

(56) References Cited

U.S. PATENT DOCUMENTS 4,542,852 A 9/1985 Orth et al.
6,315,266 B1 * 11/2001 Hirota ..... F16K 31/406 251/30.01

(Continued)

FOREIGN PATENT DOCUMENTS

CN 1621766 A 6/2005
JP S48-9685 Y1 3/1973

(Continued)

OTHER PUBLICATIONS

Translation of Imai (Year: 2014).*

(Continued)

*Primary Examiner* — Cassey D Bauer
*Assistant Examiner* — Rodrigo Royo
(74) *Attorney, Agent, or Firm* — Lucas & Mercanti, LLP

(57) ABSTRACT

An expansion valve with an improved vibration isolation mechanism includes a valve body, a valve element, a biasing member that biases the valve body toward a valve seat, an actuation rod that contacts the valve element and presses the valve element in a valve opening direction against a biasing force of the biasing member, and a vibration isolating spring that suppresses vibration of the valve element. The actuation rod is inserted into an actuation rod insertion hole in the valve body. The vibration isolating spring includes a leg spring having a base portion and a plurality of leg portions extending from the base portion. The leg spring is arranged in the valve chamber such that a center axis of the leg spring is non-coincident with a center axis of the actuation rod insertion hole.

5 Claims, 11 Drawing Sheets

(58) Field of Classification Search
CPC ..... F16L 59/184; F16L 59/181; F16F 1/122; F16F 1/126; F16F 1/128; F16F 1/324; F16F 2236/027
USPC ..... 267/179, 174, 178
See application file for complete search history.

(56) References Cited

U.S. PATENT DOCUMENTS

| | | | | |
|---|---|---|---|---|
| 7,246,501 | B2 | 7/2007 | Sohn | |
| 9,382,942 | B2 * | 7/2016 | Sakon | H02K 5/1732 |
| 10,309,702 | B2 * | 6/2019 | Kaneko | F25B 41/31 |
| 2016/0097574 | A1 | 4/2016 | Kaneko | |

FOREIGN PATENT DOCUMENTS

| | | | | |
|---|---|---|---|---|
| JP | H09-243207 | A | | 9/1997 |
| JP | H09-257341 | A | | 10/1997 |
| JP | H09-273833 | A | | 10/1997 |
| JP | 2000111208 | A | | 4/2000 |
| JP | 2013068368 | A | | 4/2013 |
| JP | 2014149128 | A | * | 8/2014 |
| JP | 2014149128 | A | | 8/2014 |
| JP | 2016070637 | A | | 5/2016 |
| JP | 6053543 | B2 | | 12/2016 |

OTHER PUBLICATIONS

International Search Report dated Aug. 7, 2018 for PCT/JP2018/021174 and English translation.
Written Opinion of ISA dated Aug. 7, 2018 for PCT/JP2018/021174 (Japanese only).
CNIPA, Chinese Office Action for the counterpart Chinese application No. 201880054288.7, dated Mar. 31, 2021, with English translation.

* cited by examiner

EXPANSION VALVE

CROSS REFERENCE TO RELATED APPLICATION

This Application is a 371 of PCT/JP2018/021174 filed on Jun. 1, 2018 which, in turn, claimed the priority of Japanese Patent Application No. 2017-160032 filed on Aug. 23, 2017, both applications are incorporated herein by reference.

TECHNICAL FIELD

The present invention relates to an expansion valve, and more particularly, to an expansion valve having a vibration isolating function.

BACKGROUND OF THE INVENTION

There is known a phenomenon in which, in expansion valves, a pressure differential between the pressure on the upstream side of a valve element and the pressure on the downstream side of the valve element causes the valve element and an actuation rod for pressing the valve element to vibrate, thereby generating a harsh noise. In order to suppress this vibration, a vibration isolating spring may be disposed in the valve body of the expansion valve.

As an example of a related technique, Patent Document 1 discloses a thermal expansion valve. The thermal expansion valve described in Patent Document 1 includes a vibration isolation member fitted to the outer surface of the actuation rod to prevent vibration of the actuation rod. The vibration isolation member has an annular portion in which an elongated plate-shaped elastic material is elastically deformed into an annular shape, and three vibration isolating springs which are formed by cutting a part of the elastic material and bending it inward. Each of the vibration isolating springs is disposed at a position such that the circumference is divided into three equal portions, and the spring force of one of the vibration isolating springs is set to be larger than the others.

CITATION LIST

Patent Literature

[Patent Document 1] Japanese Patent No. 6053543

SUMMARY OF INVENTION

Technical Problem

In the thermal expansion valve described in Patent Document 1, the spring force of one of the three vibration isolating springs is set to be larger than the spring force of the other vibration isolating springs. Accordingly, the pressing force of the vibration isolating springs against the actuation rod is not uniform. As a result, if the thermal expansion valve is used for a long period of time, wear may occur at a specific position of the actuation rod and/or at a sliding contact portion of a specific vibration isolating spring (in other words, uneven wear may occur), and the vibration isolation performance of the vibration isolation member may deteriorate. In addition, since there is a difference between the spring force of one of the three vibration isolating springs and the spring force of the other vibration isolating springs, the design of the vibration isolation members may become complicated.

Accordingly, it is therefore an object of the present invention to provide an expansion valve with an improved vibration isolation mechanism.

Solution to Problem

In order to achieve the above object, an expansion valve according to the present invention includes a valve body including a valve chamber, a valve element disposed in the valve chamber, a biasing member configured to bias the valve element toward a valve seat, an actuation rod that comes into contact with the valve element and presses the valve element in a valve opening direction against a biasing force of the biasing member, and an vibration isolating spring configured to suppress vibration of the valve element, wherein the actuation rod is inserted into an actuation rod insertion hole provided in the valve body, the vibration isolating spring includes a leg spring having a base portion and a plurality of leg portions extending from the base portion, and the leg spring is arranged in the valve chamber such that a center axis of the leg spring is non-coincident with a center axis of the actuation rod insertion hole.

In the expansion valve, the valve body may include a leg portion guide inner wall surface that the plurality of leg portions come into contact therewith. The center axis of the leg portion guide inner wall surface may be eccentric with respect to the center axis of the actuation rod insertion hole.

In the expansion valve, the plurality of leg portions may include at least a first leg portion and a second leg portion. A first contact portion that contacts the valve body may be provided at a tip portion of the first leg portion. A second contact portion that contacts the valve body may be provided at a tip portion of the second leg portion. The first contact portion and the second contact portion may differ from each other in shape or size.

In the expansion valve, the plurality of leg portions may include three or more leg portions. The three or more leg portions may be equally spaced around the center axis of the leg spring. The shapes of elastic portions of the plurality of leg portions may all be equal.

In the expansion valve, the plurality of leg portions may be unequally spaced around the center axis of the leg spring.

In the expansion valve, the plurality of leg portions may include at least a first leg portion and a second leg portion. The elasticity modulus of the first leg portion and the elasticity modulus of the second leg portion may be different from each other.

Advantageous Effects of Invention

According to the present invention, it is possible to provide an expansion valve having an improved vibration isolation mechanism.

DESCRIPTION OF EMBODIMENT(S)

Figure 1:
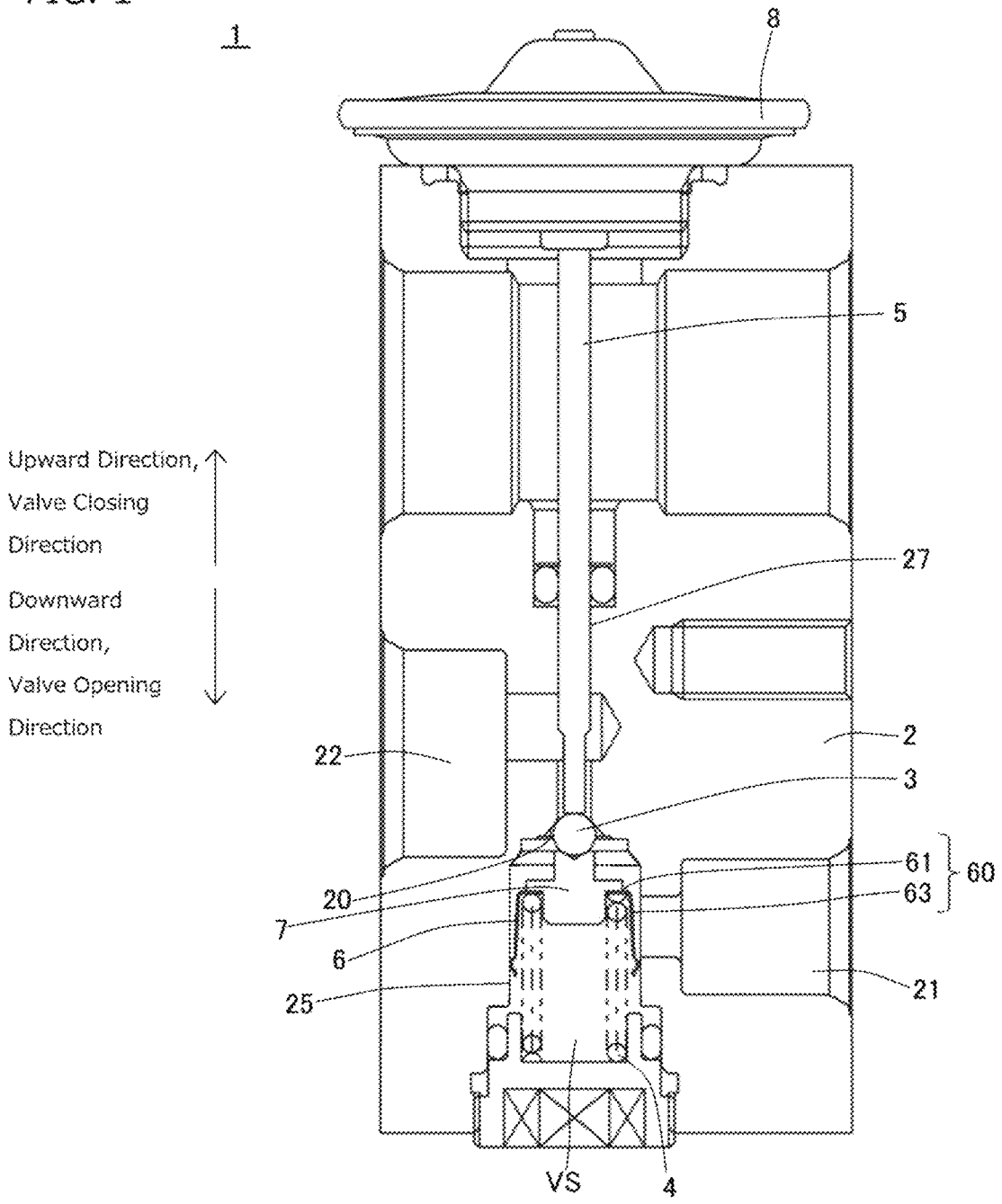
FIG. 1 is a diagram schematically illustrating the overall structure of an expansion valve according to embodiments.

Hereinafter, the expansion valve 1 according to embodiments will be described with reference to the drawings. It should be noted that, in the following description of the embodiments, components and members having the same functions are denoted by the same reference numerals, and redundant descriptions of components and members denoted by the same reference numerals are omitted.

Definition of Directions

In this specification, the direction extending from the valve element 3 toward the actuation rod 5 is defined as the "upward direction," and the direction extending from the actuation rod 5 toward the valve element 3 is defined as the "downward direction." Accordingly, in this specification, the direction extending from the valve element 3 toward the actuation rod 5 is referred to as the "upward direction" regardless of the orientation of the expansion valve 1.

Overview of Embodiments

Figure 2A:
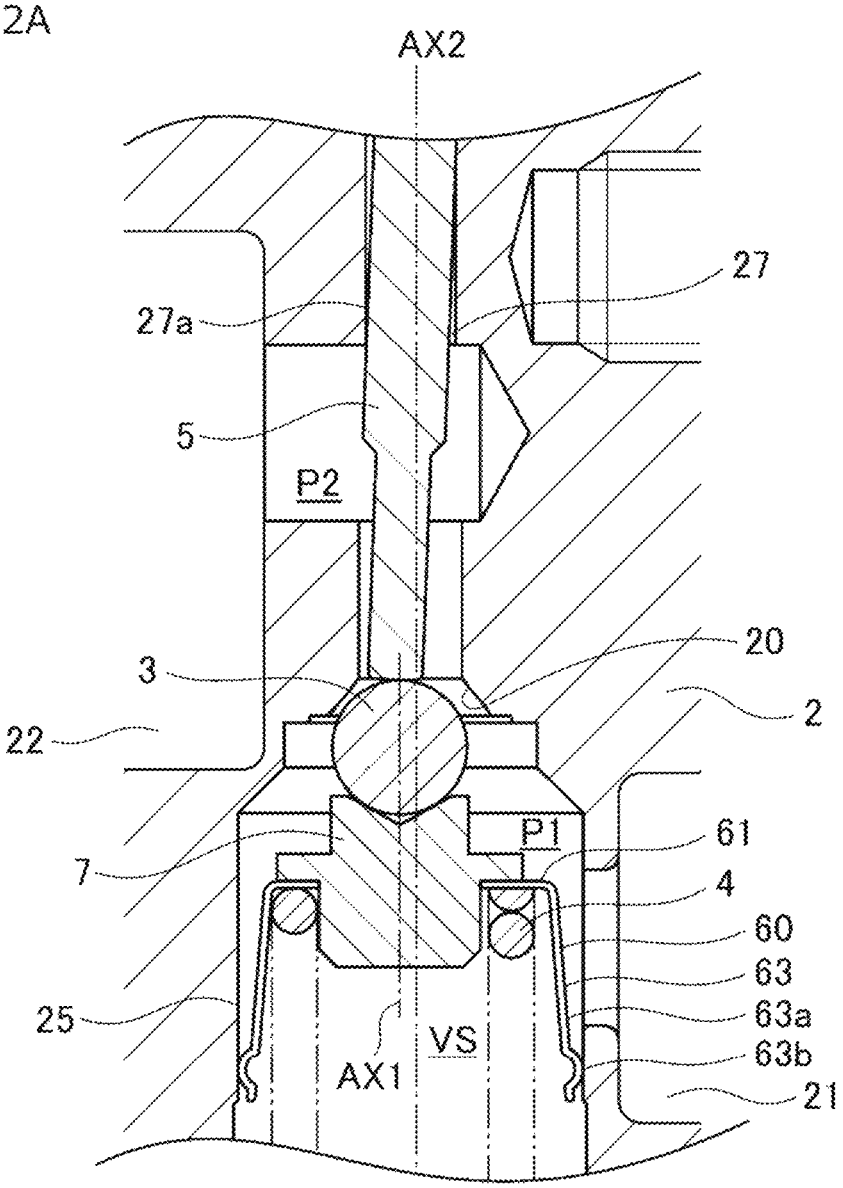
FIG. 2A is a conceptual diagram schematically illustrating an example arrangement of the actuation rod, the valve element, and the leg spring when the expansion valve is opened, according to embodiments.
Figure 2B:
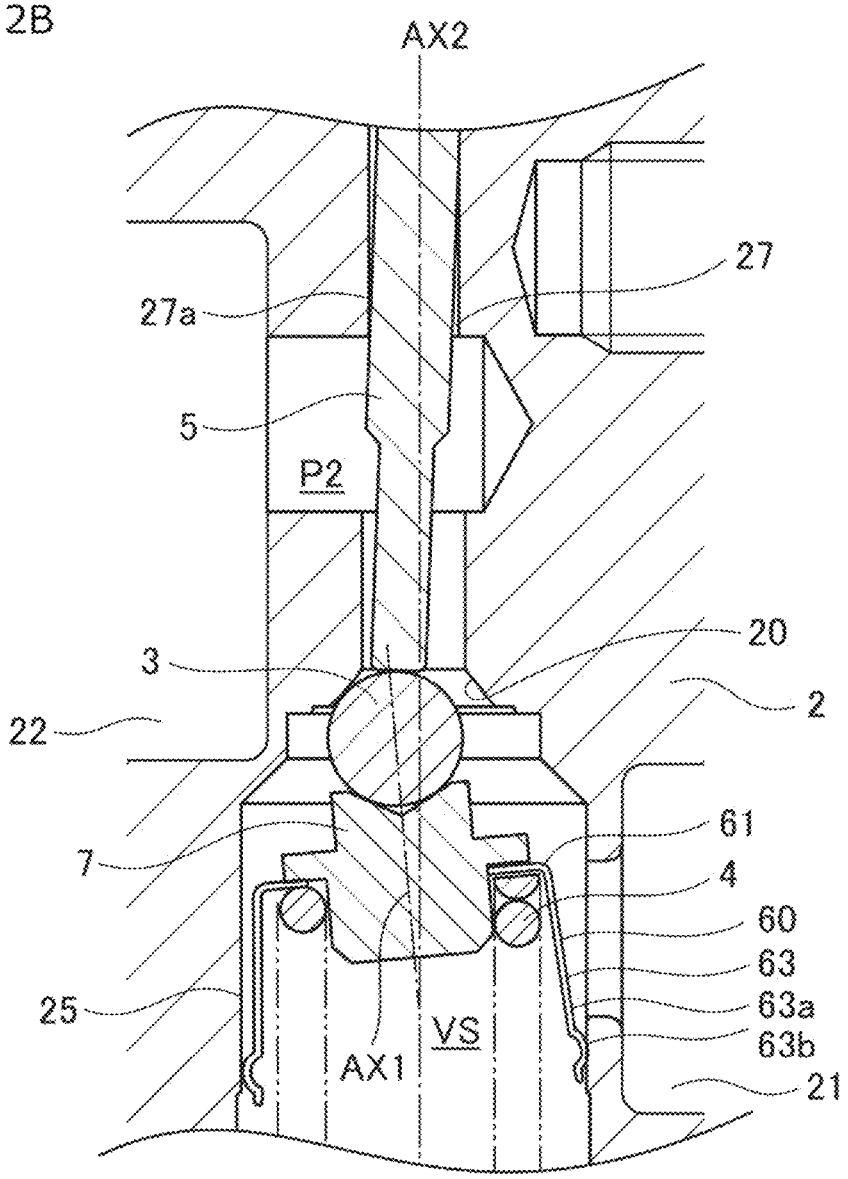
FIG. 2B is a conceptual diagram schematically illustrating another example arrangement of the actuation rod, the valve element, and the leg spring when the expansion valve is opened, according to embodiments.
Figure 3:
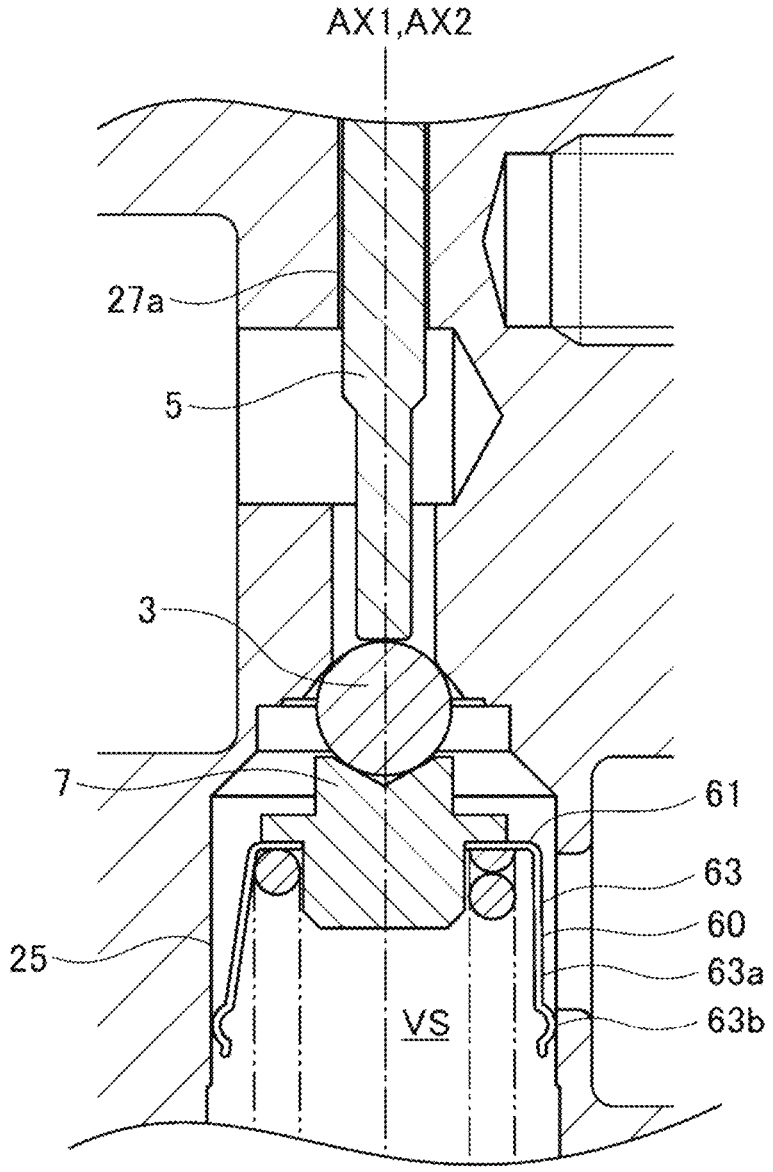
FIG. 3 is a conceptual diagram schematically illustrating an arrangement of the actuation rod, the valve element, and the leg spring when the expansion valve is closed, according to embodiments.

An overview of the expansion valve 1 according to the embodiments will be described with reference to FIG. 1. FIG. 1 is a diagram schematically illustrating the overall structure of the expansion valve 1 according to the embodiment. It should be noted that in FIG. 1, a portion corresponding to the power element 8 is illustrated in a side view, and the other portions are illustrated in a cross-sectional view. FIG. 2A is a conceptual diagram schematically illustrating an example arrangement of the actuation rod 5, the valve element 3, and the leg spring (leg attaching spring) 60 when the expansion valve 1 is opened, according to embodiments. FIG. 2B is a conceptual diagram schematically illustrating another example arrangement of the actuation rod 5, the valve element 3, and the leg spring 60 when the expansion valve 1 is opened, according to embodiments. FIG. 3 is a conceptual diagram schematically illustrating an arrangement of the actuation rod 5, the valve element 3, and the leg spring 60 when the expansion valve 1 is closed, according to embodiments.

The expansion valve 1 includes a valve body 2 including a valve chamber VS, a valve element 3, a biasing member 4, an actuation rod 5, and a vibration isolating spring 6.

In addition to the valve chamber VS, the valve body 2 includes a first flow path 21 and a second flow path 22. The first flow path 21 is, for example, a supply-side flow path, and a fluid is supplied to the valve chamber VS via the supply-side flow path. The second flow path 22 is, for example, a discharge side flow path, and the fluid in the valve chamber VS is discharged to the outside of the expansion valve via the discharge side flow path.

The valve element 3 is disposed in the valve chamber VS. When the valve element 3 is seated on the valve seat 20 of the valve body 2, the first flow path 21 and the second flow path 22 are in a non-communicative state. In contrast, when the valve element 3 is separated from the valve seat 20, the first flow path 21 and the second flow path 22 are in a communicative state.

The biasing member 4 biases the valve element 3 toward the valve seat 20. The biasing member 4 is, for example, a coil spring.

The lower end of the actuation rod 5 is in contact with the valve element 3. The actuation rod 5 presses the valve element 3 in the valve opening direction against the biasing force of the biasing member 4. When the actuation rod 5 moves downward, the valve element 3 is separated from the valve seat 20, and the expansion valve 1 enters an open state. The actuation rod 5 is inserted into an actuation rod insertion hole 27 provided in the valve body 2.

The vibration isolating spring 6 is a vibration isolating member for suppressing vibration of the valve element 3. The vibration isolating spring 6 includes a leg spring 60, and the leg spring 60 includes a base portion 61 and a plurality of leg portions 63 extending from the base portion 61.

As illustrated in FIG. 2A and FIG. 2B, in embodiments, in the open state of the expansion valve 1, the leg spring 60 is disposed in the valve chamber VS such that the center axis AX1 of the leg spring 60 is non-coincident with the center axis AX2 of the actuation rod insertion hole 27. It should be noted that the fact that the center axis AX1 is non-coincident with the center axis AX2 includes (1) that the center axis AX1 is parallel to the center axis AX2 as illustrated in FIG. 2A (in other words, the center axis AX1 is eccentric from the center axis AX2), and (2) that the center axis AX1 is inclined with respect to the center axis AX2 as illustrated in FIG. 2B. In addition, in the case that the center axis AX1 is inclined with respect to the center axis AX2, the center axis AX1 may intersect the center axis AX2 (as illustrated in FIG. 2B) or the center axis AX1 need not intersect the center axis AX2. In the present specification, the fact that the center axis AX1 is non-coincident with the center axis AX2 is expressed as deviation of the center axis AX1 from the center axis AX2.

Figure 4:
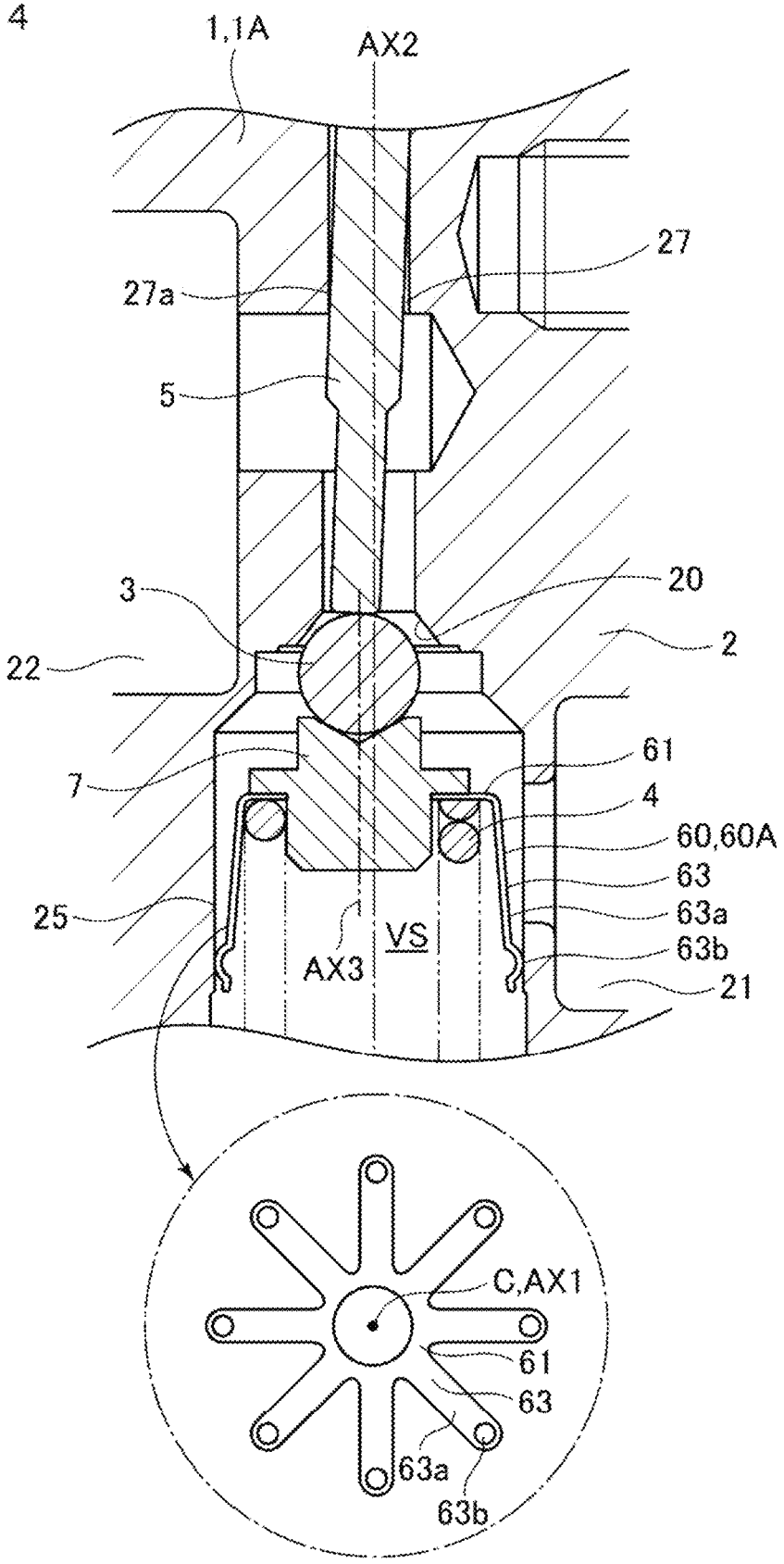
FIG. 4 is an expanded view of an area around the leg spring of the expansion valve, according to a first embodiment.

It should be noted that the center axis AX1 of the leg spring 60 is, for example, an axis that passes through the center C of the base portion 61 and extends vertically (see the lower diagram of FIG. 4, for example). Alternatively, since the leg spring 60 moves integrally with the valve element 3, the center axis AX1 of the leg spring may be defined as the center axis of the valve element 3.

In embodiments, when the expansion valve 1 is in the open state, the center axis AX1 of the leg spring 60 deviates from the center axis AX2 of the actuation rod insertion hole 27. Accordingly, the valve element 3, which is isolated from vibration by the leg spring 60, is eccentric from the central axial AX2 of the actuation rod insertion hole 27. As a result, as illustrated in FIG. 2A and FIG. 2B, a portion of the actuation rod 5 that contacts the valve element 3 also contacts the inner wall surface 27*a* (inner wall surface of the valve body 2) that defines the actuation rod insertion hole 27.

In embodiments, since a portion of the actuation rod 5 contacts the inner wall surface 27*a*, the vibration of the actuation rod 5 in the lateral direction (that is, in the direction perpendicular to the lengthwise direction of the actuation rod 5) is suppressed. In other words, in embodiments, the actuation rod 5 is pressed against the inner wall surface 27*a*, thereby applying a lateral restraining force to the actuation rod 5. In addition, in embodiments, since a portion of the actuation rod 5 contacts the inner wall surface 27*a*, vibration of the actuation rod 5 in the longitudinal direction (that is, in the direction along the lengthwise direction of the actuation rod 5) is also suppressed. In other words, in embodiments, the actuation rod 5 is pressed against the inner wall surface 27*a*, thereby imparting a sliding resistance in the longitudinal direction to the actuation rod 5.

As described above, in embodiments, a lateral restraining force and a longitudinal sliding resistance are applied to the actuation rod 5. Thus, in the expansion valve 1 according to embodiments, the vibration of the actuation rod 5 is effectively suppressed.

When the valve opening degree is small, in other words, when the separation distance between the valve element 3 and the valve seat 20 is small as illustrated in FIG. 2A and FIG. 2B, the pressure differential between the pressure P1 on the upstream side of the valve element 3 and the pressure P2 on the downstream side of the valve element 3 is large. This pressure differential causes the valve element 3 to vibrate laterally. However, in embodiments, since a lateral restraining force is applied to the actuation rod 5, this lateral restraining force is also applied to the valve element 3 contacting the actuation rod 5. As a result, the lateral vibration of the valve element 3 is suppressed. In addition, in embodiments, since the sliding resistance in the longitudinal direction is applied to the actuation rod 5, it is difficult for the valve element 3 in contact with the actuation rod 5 to move in the longitudinal direction as well. That is, in embodiments, the vibration of the valve element 3 in the longitudinal direction is also suppressed.

It should be noted that, as illustrated in FIG. 3, in embodiments, in the closed state of the expansion valve 1, the center axis AX1 of the leg spring 60 may coincide with the center axis AX2 of the actuation rod insertion hole 27.

In embodiments, the leg spring 60 includes three or more leg portions 63, and it is preferable that the three or more leg portions 63 are arranged so as to be equally spaced around the center axis AX1 of the leg spring 60.

In addition, it is preferable that the shapes of the elastic portions 63*a* of the plurality of leg portions 63 are all equal to each other. When the plurality of leg portions 63 are arranged so as to be equally spaced and the shapes of the elastic portions 63*a* of the plurality of leg portions 63 are all equal, the valve element 3 receives substantially the same biasing force from each of the plurality of leg portions 63. For this reason, it is easy to obtain the desired vibration isolation performance (vibration isolation performance in accordance with the designed values). In addition, uneven wear is less likely to occur on the leg portion guide inner wall surface 25 that contacts a particular leg portion 63.

In embodiments, the expansion valve 1 may include a valve element support member 7. The valve element support member 7 supports the valve element 3. In the example illustrated in FIG. 1, the valve element support member 7 supports the valve element 3 from below.

In the example illustrated in FIG. 1, the leg spring 60 is disposed between the valve element support member 7 and the leg portion guide inner wall surface 25, and the base portion 61 of the leg spring 60 is disposed between the valve element support member 7 and the biasing member 4. Accordingly, in the example illustrated in FIG. 1, the leg spring 60 moves substantially integrally with the valve element support member 7 and the valve element 3 in the vertical direction and/or the lateral direction.

First Embodiment

Figure 5:
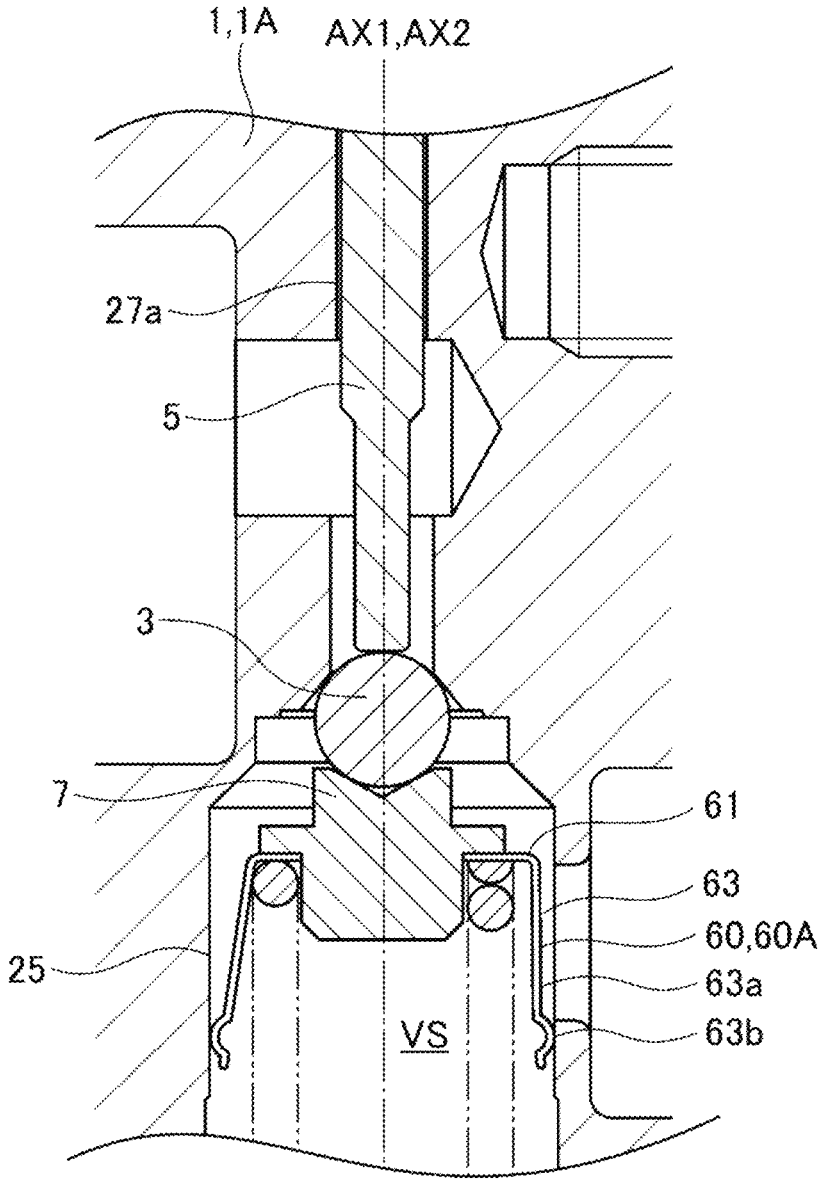
FIG. 5 is an expanded view of an area around the leg spring of the expansion valve, according to a first embodiment.
Figure 6:
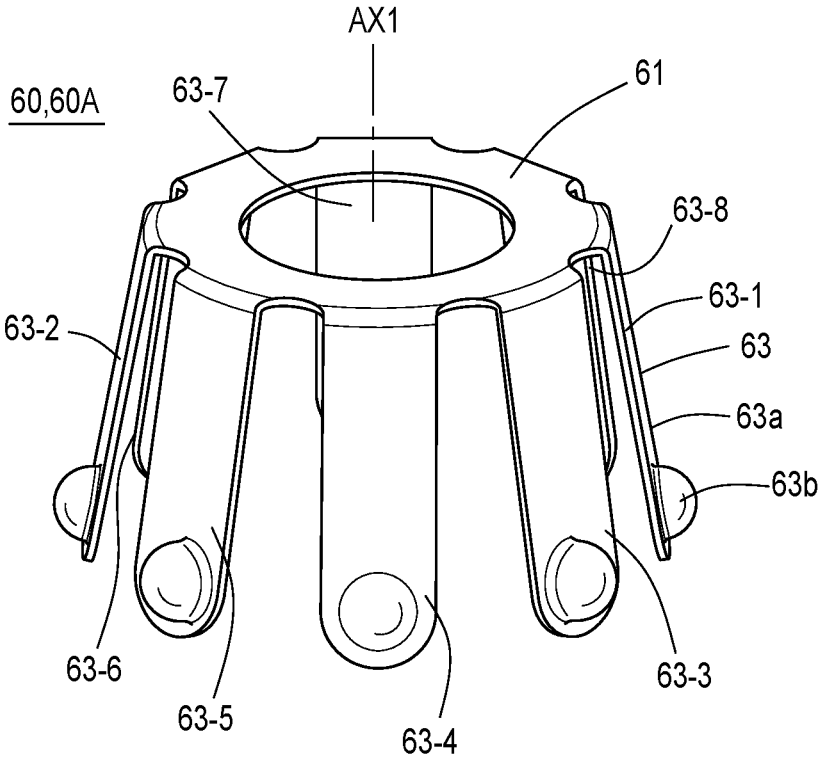
FIG. 6 is a schematic perspective view schematically illustrating an example of a leg spring.

The expansion valve 1A according to the first embodiment will be described with reference to FIG. 4 to FIG. 6. FIG. 4 and FIG. 5 are expanded views of the area around the leg spring 60A of the expansion valve 1A according to the first embodiment. FIG. 4 illustrates an open state of the expansion valve 1A, and FIG. 5 illustrates a closed state of the expansion valve 1A. It should be noted that in FIG. 4, an exploded view of the leg spring 60A is illustrated in the area surrounded by the dashed line. FIG. 6 is a schematic perspective view schematically illustrating an example of the leg spring 60A.

The overall structure of the expansion valve 1A in the first embodiment is the same as the overall structure of the expansion valve 1 illustrated in FIG. 1. Accordingly, a redundant explanation of the entire structure of the expansion valve 1A will be omitted.

In the expansion valve 1A according to the first embodiment, the center axis AX3 of the leg portion guide inner wall surface 25 is eccentric from the center axis AX2 of the actuation rod insertion hole 27, such that the center axis AX1 of the leg spring 60A deviates from the center axis AX2 of the actuation rod insertion hole 27.

In the first embodiment, the valve body 2 comprises a leg portion guide inner wall surface 25 against which a plurality of leg portions 63 come into contact therewith. In the example illustrated in FIG. 5, the leg portion guide inner wall surface 25 is a portion of the wall surface that defines the valve chamber VS, and is a wall surface having a substantially cylindrical shape. In cases in which the leg portion guide inner wall surface 25 has a cylindrical shape, the center axis AX3 of the leg portion guide inner wall surface 25 corresponds to the center axis of the cylinder.

In the first embodiment, the center axis AX3 of the leg portion guide inner wall surface 25 is eccentric from the center axis AX2 of the actuation rod insertion hole 27. Accordingly, when the plurality of leg portions 63 contact the leg portion guide inner wall surface 25, the center axis AX1 of the leg spring 60A deviates from the center axis AX2 of the actuation rod insertion hole 27. As a result, since a portion of the actuation rod 5 comes into contact with the inner wall surface 27*a* defining the actuation rod insertion hole 27, the vibration of the actuation rod 5 and the valve element 3 is suppressed.

In the first embodiment, the vibration-isolation characteristics of the actuation rod 5 and the valve element 3 are improved simply by causing the center axis AX3 of the leg portion guide inner wall surface 25 to be eccentric from the center axis AX2 of the actuation rod insertion hole 27. For this reason, a known leg spring can be used as-is as the leg spring 60A. Accordingly, the design cost and/or the manufacturing cost of the leg spring 60A can be suppressed.

Needless to say, a newly designed leg spring may be employed as the leg spring 60A in the first embodiment.

(Example of the Leg Spring)

An example leg spring 60A that can be utilized in the expansion valve 1A of the first embodiment will be described with reference to FIG. 6.

The leg spring 60A includes a base portion 61 and a plurality of leg portions 63 extending downward from the base portion 61. In the example illustrated in FIG. 6, the leg spring 60A includes eight leg portions, in other words, a first leg portion 63-1 to an eighth leg portion 63-8. However, it may be sufficient for the number of leg portions of the leg spring 60A to be three or more.

The leg portions 63 are arranged so as to be equally spaced around the center axis AX1 of the leg spring 60A. More specifically, the leg portions 63 are arranged so as to be equally spaced along the outer edge of the base portion 61.

In the example illustrated in FIG. 6, each leg portion 63 includes an elastic portion 63*a* and a tip-side protrusion portion 63*b* protruding outward at the tip portion. Then, as illustrated in FIG. 4, the tip-side protrusion portion 63*b* comes into contact with the leg portion guide inner wall surface 25. The tip-side protrusion portion 63*b* may have a partially spherical shell shape. It should be noted that the partially spherical shell shape refers to a shape that coincides with or substantially coincides with a part of a spherical shell. In the case that the tip-side protrusion portion 63*b* has a partially spherical shell shape, since the portion in contact with the leg portion guide inner wall surface 25 becomes a smooth curved surface portion, the leg portion guide inner wall surface 25 is unlikely to be damaged. In addition, since the partial spherical shell shape is a shape having high structural strength, the shape of the tip-side protrusion portion 63*b* is unlikely to collapse over a long period of time.

It should be noted that, in the case that the leg spring 60A is made of metal, the tip-side protrusion portion 63*b* can be formed by plastically deforming a portion of the leg portion 63 by press working. In other words, the tip-side protrusion portion 63*b* may be a plastically deformed portion.

It should be noted that, in the example illustrated in FIG. 6, the base portion 61 has a ring shape, and the plurality of leg portions 63 extend downward from the outer edge portion of the ring. However, the shape of the base portion 61 is not limited to a ring shape.

In the leg spring 60A illustrated in FIG. 6, the shapes of the elastic portions 63*a* of the plurality of leg portions 63 are all equal. In other words, when the number of leg portions 63 included in the leg spring 60A is defined as N, and K is defined as an arbitrary natural number less than or equal to N−1, the length of the K-th leg portion 63-K is equal to the length of the K+1-th leg portion, the width of the K-th leg portion 63-K is equal to the width of the K+1-th leg portion, and the thickness of the K-th leg portion 63-K is equal to the thickness of the K+1-th leg portion. In addition, in the leg spring 60A illustrated in FIG. 6, the shapes of the tip-side protrusion portions 63*b* of the plurality of leg portions 63 are all equal.

Accordingly, in the expansion valve 1A, in the case that the leg spring 60A illustrated in FIG. 6 is utilized, the valve element 3 receives substantially the same biasing force from each of the plurality of leg portions 63. For this reason, it is easier to obtain a desired vibration-isolation performance (vibration isolation performance in accordance with the designed values). In addition, uneven wear is less likely to occur on the leg portion guide inner wall surface 25 that contacts a particular leg portion 63. Further, since the shapes of the plurality of leg portions 63 are all equal, the leg spring 60A can be easily processed, and the manufacturing cost of the leg spring 60A can be suppressed.

Second Embodiment

Figure 7:
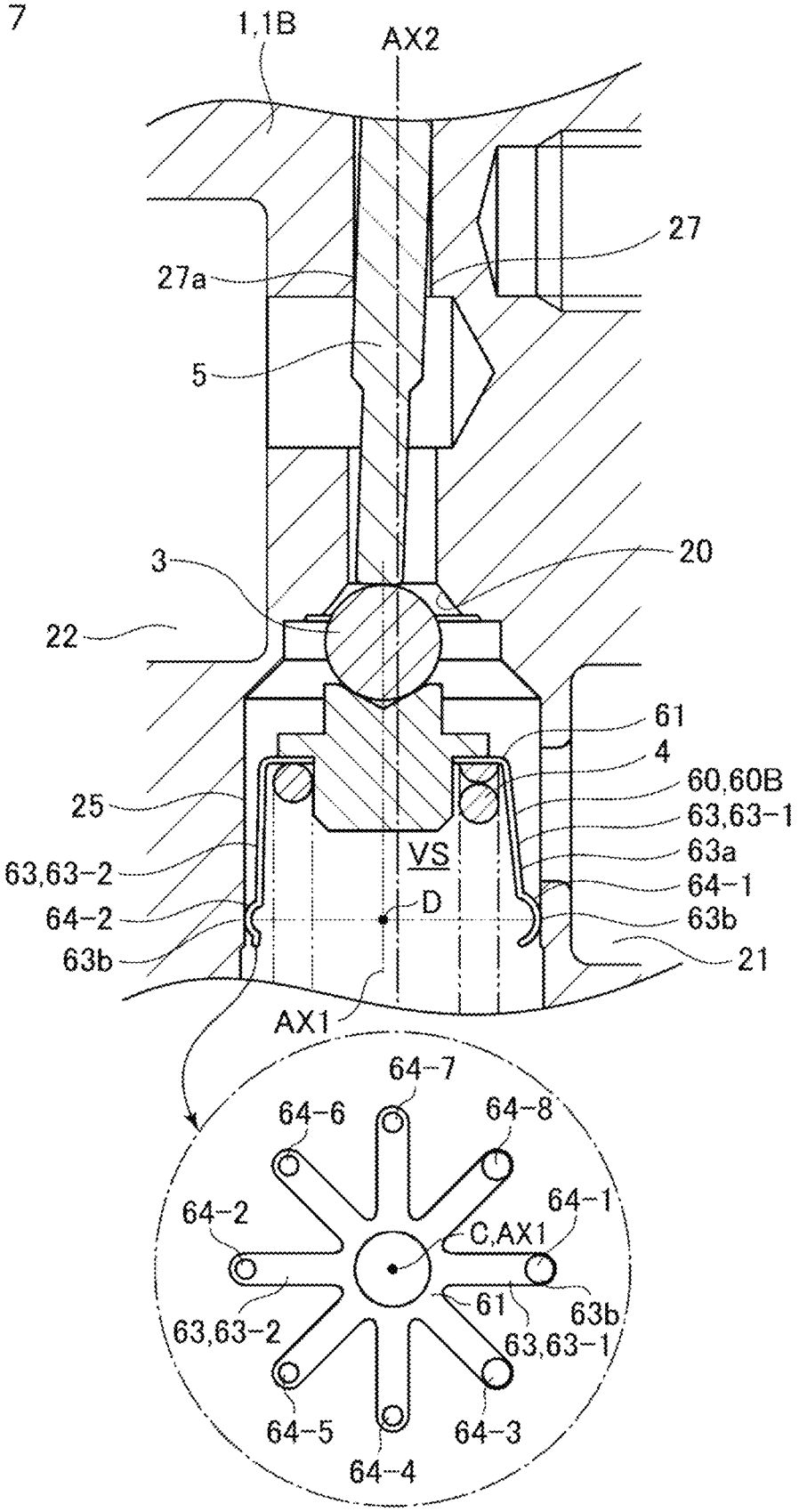
FIG. 7 is an expanded view of an area around the leg spring of the expansion valve, according to a second embodiment.
Figure 8:
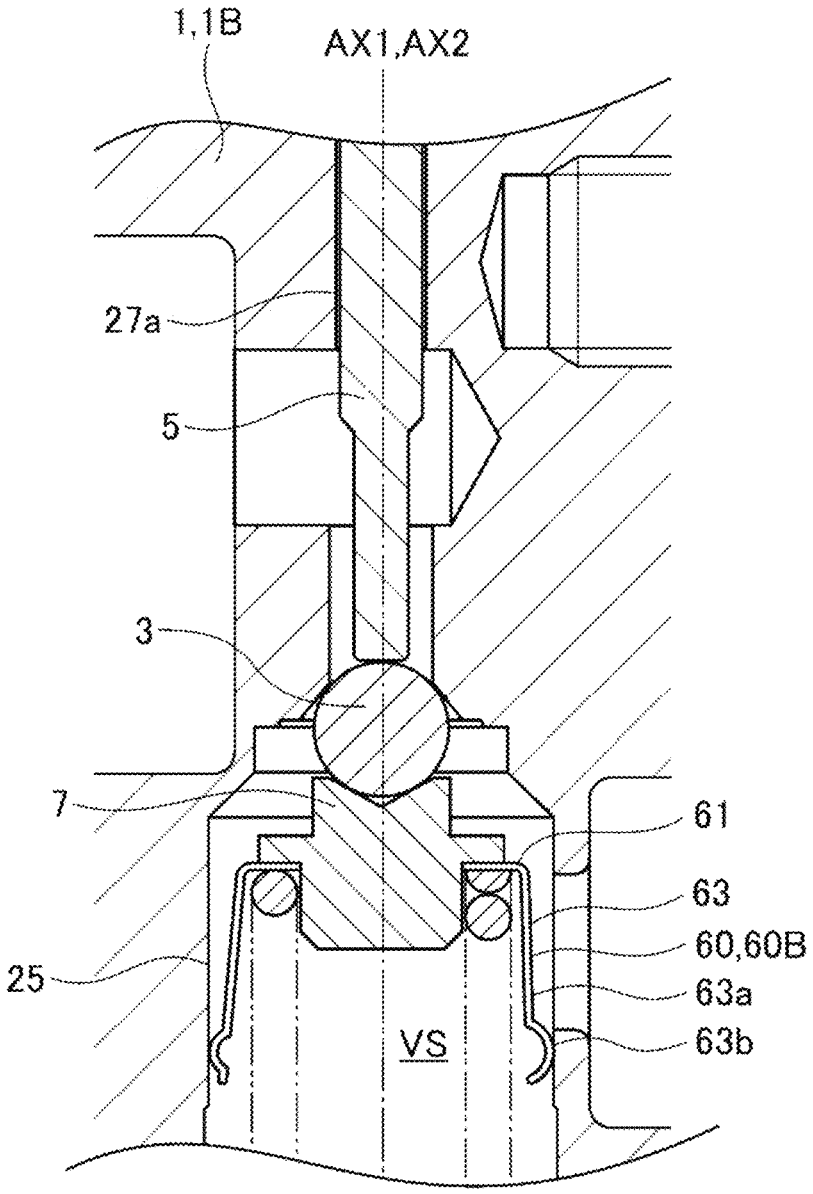
FIG. 8 is an expanded view of an area around the leg spring of the expansion valve, according to a second embodiment.

The expansion valve 1B according to the second embodiment will be described with reference to FIG. 7 and FIG. 8. FIG. 7 and FIG. 8 are expanded views of the area around the leg spring 60B of the expansion valve 1B in the second embodiment. FIG. 7 illustrates an open state of the expansion valve 1B, and FIG. 8 illustrates a closed state of the expansion valve 1A. It should be noted that in FIG. 7, an exploded view of the leg spring 60B is illustrated in the area surrounded by the dashed line.

The overall structure of the expansion valve 1B in the second embodiment is the same as the overall structure of the expansion valve 1 illustrated in FIG. 1. For this reason, a redundant explanation of the entire structure of the expansion valve 1B will be omitted.

In the expansion valve 1B according to the second embodiment, since the shape or size of the first contact portion 64-1 of the first leg portion 63-1 differs from the shape or size of the second contact portion 64-2 of the second leg portion 63-2, the center axis AX1 of the leg spring 60A deviates from the center axis AX2 of the actuation rod insertion hole 27.

The leg spring 60B of the expansion valve 1B in the second embodiment includes a base portion 61 and a plurality of leg portions 63 extending downward from the base portion 61. The leg portions 63 are arranged so as to be equally spaced around the center axis AX1 of the leg spring 60A. More specifically, the leg portions 63 are arranged so as to be equally spaced along the outer edge of the base portion 61.

In the example illustrated in FIG. 8, each leg portion 63 comprises an elastic portion 63*a* and a tip-side protrusion portion 63*b* projecting outwardly at the tip portion. In the example illustrated in FIG. 8, the tip-side protrusion portion 63*b* of the first leg portion 63-1 corresponds to the first contact portion 64-1, and the tip-side protrusion portion 63*b* of the second leg portion 63-2 corresponds to the second contact portion 64-2. The first contact portion 64-1 and the second contact portion 64-2 contact the valve body 2 (more specifically, the leg portion guide inner wall surface 25).

In the example illustrated in FIG. 8, the size of the first contact portion 64-1 is different from the size of the second contact portion 64-2. Alternatively or additionally, the shape of the first contact portion 64-1 (for example, the protrusion height of the tip-side protrusion portion 63*b* of the first leg portion 63-1) and the shape of the second contact portion 64-2 (for example, the protrusion height of the tip-side protrusion portion 63*b* of the second leg portion 63-2) may be different.

In the second embodiment, two contact portions having different shapes or different sizes, (that is, the first contact portion 64-1 and the second contact portion 64-2), may be disposed opposite to each other with respect to the center axial AX1 of the leg spring 60. It should be noted that the opposing arrangement is not limited to an opposing arrangement in the strict sense. If the angle formed between the line segment connecting the first contact portion 64-1 and the point D on the center axis AX1 and the line segment connecting the second contact portion 64-2 and the point D is 120 degrees or more, the first contact portion 64-1 and the second contact portion 64-2 are considered to be disposed opposite to each other with respect to the center axis AX1 of the leg spring 60 in the present specification. By making the shapes or sizes of the two oppositely disposed contact portions different, the center axis AX1 of the leg spring 60 deviates more significantly from the center axis AX2 of the actuation rod insertion hole 27.

In addition, in the second embodiment, a plurality of large-sized contact portions having a relatively large size may be prepared, and a plurality of small-sized contact portions having a relatively small size may be prepared. In the example illustrated in FIG. 6, the first contact portion 64-1, the third contact portion 64-3, and the eighth contact portion 64-8 are large-sized contact portions provided at the tip portion of the leg portion 63, and the second contact portion 64-2, the fourth contact portion 64-4, the fifth contact portion 64-5, the sixth contact portion 64-6, and the seventh contact portion 64-7 are small-sized contact portions provided at the tip portions of the leg portion 63. It should be noted that it is preferable for the plurality of large-sized contact portions to be arranged adjacent to each other, and for the plurality of small-sized contact portions to be arranged adjacent to each other.

In the second embodiment, the shape or size of the first contact portion 64-1 is different from the shape or size of the second contact portion 64-2. For this reason, when both the first contact portion 64-1 and the second contact portion 64-2 come into contact with the valve body 2 (more specifically, the leg portion guide inner wall surface 25), the center axis AX1 of the leg spring 60B deviates from the center axis AX2 of the actuation rod insertion hole 27. As a result, a portion of the actuation rod 5 comes into contact with the inner wall surface 27*a* that defines the actuation rod insertion hole 27, so that the vibration of the actuation rod 5 and the valve element 3 are suppressed.

In the second embodiment, the vibration isolation characteristics of the actuation rod 5 and the valve element 3 are improved simply by making the shape or size of the first contact portion 64-1 different from the shape or size of the second contact portion 64-2. Accordingly, a leg spring having an improved shape or size of the contact portion among known leg springs may be utilized as the leg spring 60B. For example, a leg spring in which only the shape or size of the contact portion is changed from the leg spring 60A described in the "example of the leg spring" in the first embodiment may be adopted as the leg spring 60B in the second embodiment. Needless to say, a newly designed leg spring may be employed as the leg spring 60B in the second embodiment.

It should be noted that in the leg spring 60B according to the second embodiment, the shapes of the elastic portions 63*a* of the plurality of leg portions 63 may be all equal. In this case, since the valve element 3 receives a biasing force of substantially the same degree from each of the plurality of leg portions 63, the desired vibration isolation performance (vibration isolation performance in accordance with the designed values) is easily obtained. In addition, uneven wear is less likely to occur on the leg portion guide inner wall surface 25 that contacts a particular leg portion 63.

Third Embodiment

Figure 9:
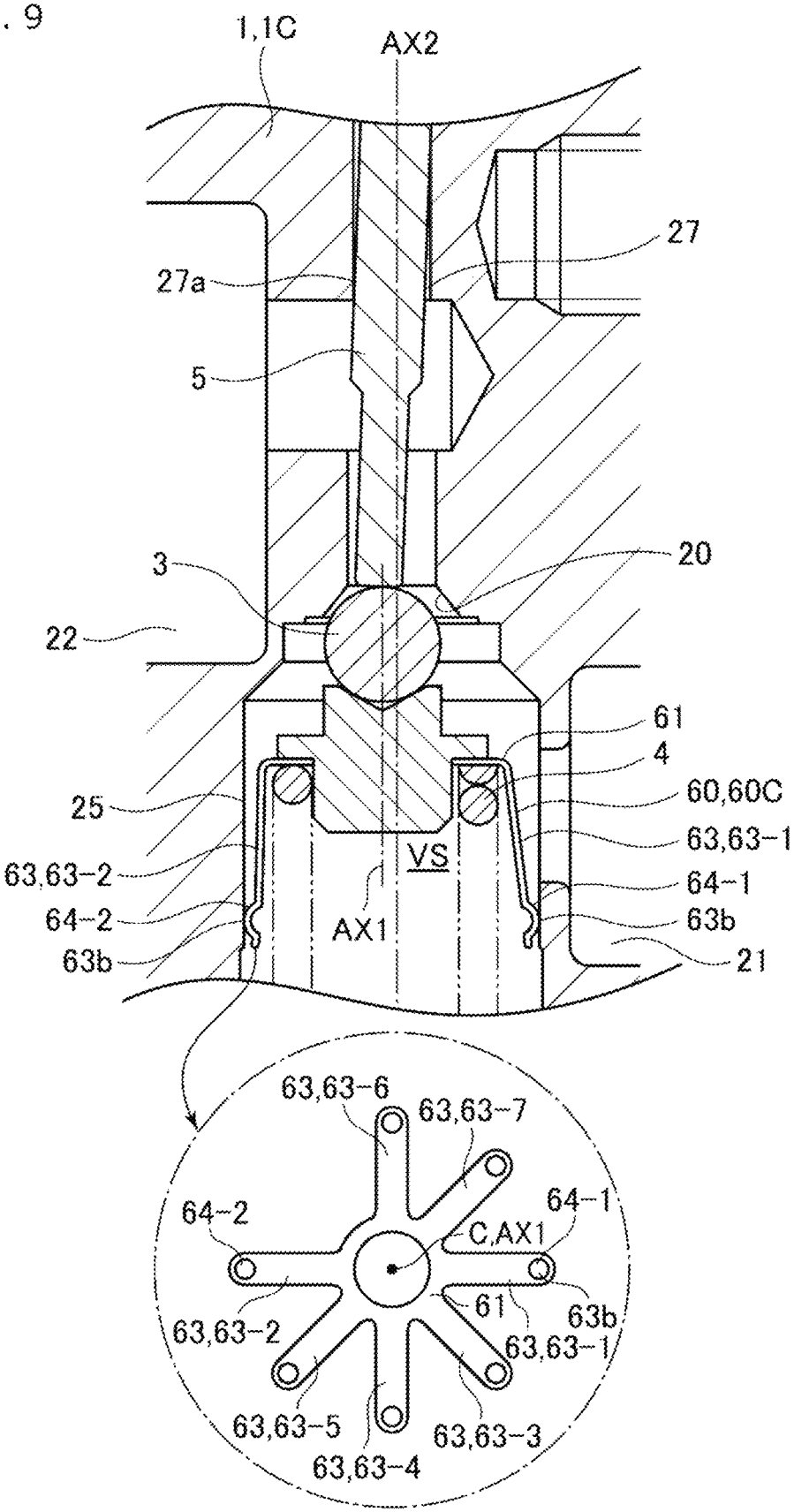
FIG. 9 is an expanded view of an area around the leg spring of the expansion valve, according to a third embodiment.

An expansion valve 1C according to the third embodiment will be described with reference to FIG. 9. FIG. 9 is an expanded view of the area around the leg spring 60C of the expansion valve 1C according to the third embodiment. It should be noted that, in FIG. 9, an exploded view of the leg spring 60C is illustrated in the area surrounded by the dashed line.

The overall structure of the expansion valve 1C in the third embodiment is the same as the overall structure of the expansion valve 1 illustrated in FIG. 1. Accordingly, a redundant explanation of the entire structure of the expansion valve 1C will be omitted.

In the expansion valve 1C according to the third embodiment, by arranging the plurality of leg portions 63 at unequal intervals around the center axis AX1 of the leg spring 60C, the center axis AX1 of the leg spring 60C deviates from the center axis AX2 of the actuation rod insertion hole 27.

The leg spring 60C of the expansion valve 1C in the third embodiment includes a base portion 61 and a plurality of leg portions 63 extending downward from the base portion 61. The leg portions 63 are arranged so as to be equally spaced around the center axis AX1 of the leg spring 60A. More specifically, the leg portions 63 are arranged so as to be equally spaced along the outer edge of the base portion 61.

In the example illustrated in FIG. 9, the distance between the first leg portion 63-1 and the leg portion adjacent to the first leg portion (the third leg portion 63-3) is smaller than the distance between the second leg portion 63-2 disposed opposite to the first leg portion 63-1 and the leg portion adjacent to the second leg portion (the sixth leg portion 63-6). For this reason, when both the first contact portion 64-1 and the second contact portion 64-2 come into contact with the valve body 2 (more specifically, the leg portion guide inner wall surface 25), the center axis AX1 of the leg spring 60B deviates from the center axis AX2 of the actuation rod insertion hole 27. As a result, a portion of the actuation rod 5 comes into contact with the inner wall surface 27*a* that defines the actuation rod insertion hole 27, so that the vibration of the actuation rod 5 and the valve element 3 are suppressed.

In the third embodiment, the vibration isolation characteristics of the actuation rod 5 and the valve element 3 are improved simply by disposing the plurality of leg portions 63 at unequal intervals around the center axis AX1 of the leg spring 60C. Accordingly, a leg spring having an improved leg portion arrangement among known leg springs may be utilized as the leg spring 60C. For example, a leg spring in which only the arrangement of the leg portions 63 is changed from the leg spring 60A described in the "example of the leg spring" in the first embodiment may be utilized as the leg spring 60C in the third embodiment. Needless to say, a newly designed leg spring may be employed as the leg spring 60C in the third embodiment.

It should be noted that, in the leg spring 60C of the third embodiment, the shapes of the elastic portions 63*a* of the plurality of leg portions 63 (or the overall shapes of the plurality of leg portions 63) may be all equal. In this case, the dimensions of the individual leg portions need not be designed separately, since the leg portions have a common shape. Accordingly, the design of the leg spring does not become complicated.

Alternatively, in the leg spring 60C of the third embodiment, the shapes of the elastic portions 63*a* of the plurality of leg portions 63 may be different from each other. For example, the shape of the first leg portion 63-1 and the shape of the second leg portion 63-2 may be different from each other. In this case, the elasticity modulus of the first leg portion 63-1 and the elasticity modulus of the second leg portion 63-2 differ from each other. In the case that the elasticity modulus of the first leg portion 63-1 and the elasticity modulus of the second leg portion 63-2 are different from each other, uneven wear tends to occur as compared with the case where the elasticity modulus of the first leg portion 63-1 and the elasticity modulus of the second leg portion 63-2 are equal to each other. However, by making the elasticity modulus of the first leg portion 63-1 and the elasticity modulus of the second leg portion 63-2 different from each other, the center axis AX1 of the leg spring 60 may deviate more significantly from the center axis AX2 of the actuation rod insertion hole 27. Accordingly, in the third embodiment, the elasticity modulus of the first leg portion 63-1 and the elasticity modulus of the second leg portion 63-2 may be different from each other.

Since the elasticity modulus of the first leg portion 63-1 and the elasticity modulus of the second leg portion 63-2 are made to be different from each other, the width of the first leg portion 63-1 and the width of the second leg portion 63-2 may also be different from each other. Alternatively or additionally, the length of the first leg portion 63-1 and the length of the second leg portion 63-2 may be different from each other. When manufacturing the leg spring 60C from a single sheet, it is relatively easy to make the width or length different between the plurality of leg portions. Alternatively or additionally, the thickness of the first leg portion 63-1 and the thickness of the second leg portion 63-2 may be different from each other.

(Application Example of Expansion Valve 1)

Figure 10:
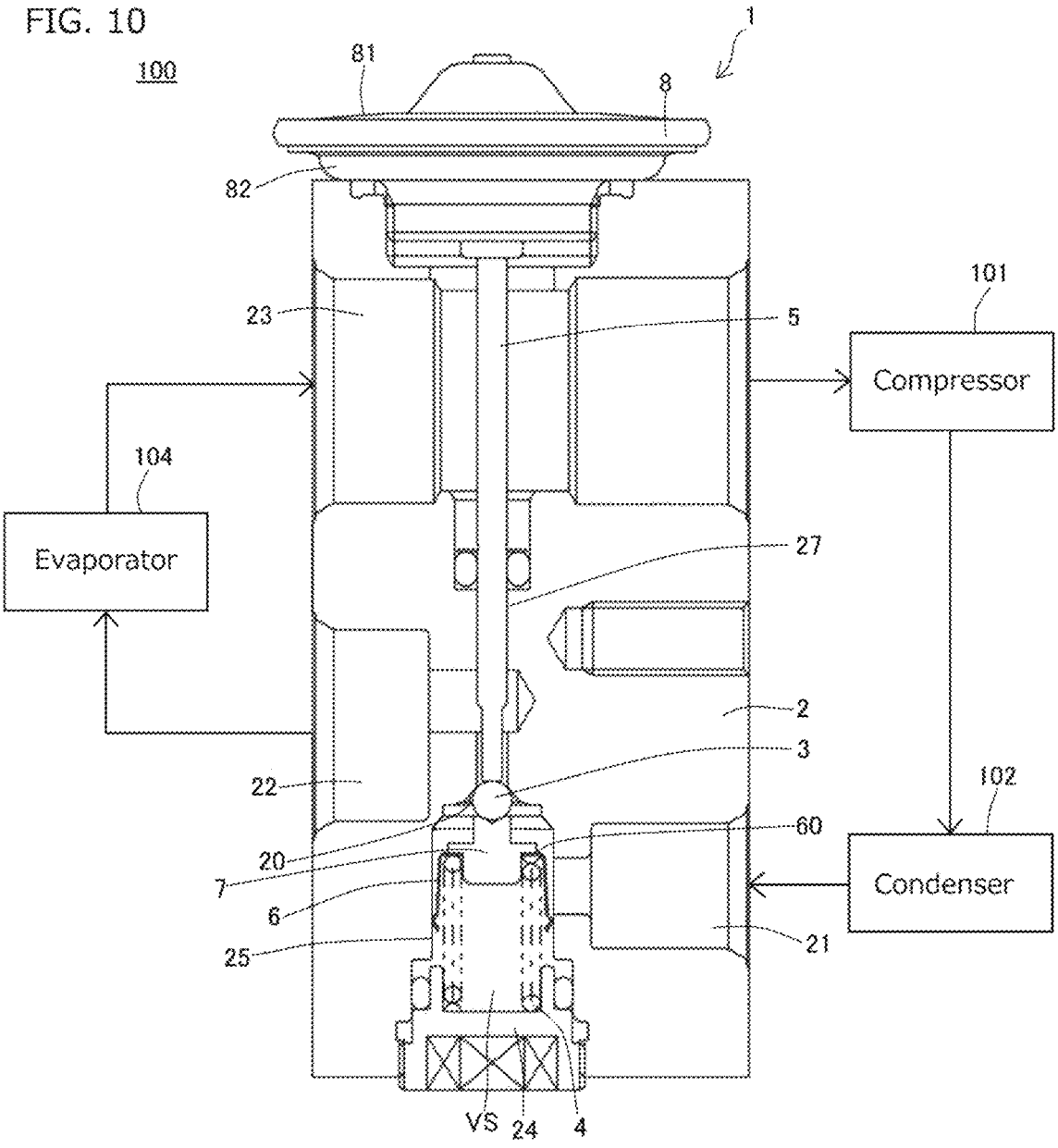
FIG. 10 is a schematic cross-sectional view schematically illustrating an example of applying the expansion valve according to embodiments to a refrigerant circulation system.

An application example of the expansion valve 1 will be described with reference to FIG. 10. FIG. 10 is a schematic cross-sectional view schematically illustrating an example in which the expansion valve 1 according to embodiments is applied to a refrigerant circulation system 100.

In the example illustrated in FIG. 10, the expansion valve 1 is fluidly connected to a compressor 101, a condenser 102, and an evaporator 104.

In addition to the valve body 2, the valve element 3, the biasing member 4, the actuation rod 5, the vibration isolating spring 6, the first flow path 21, and the second flow path 22, the expansion valve 1 includes a power element 8 and a return flow path 23.

Referring to FIG. 10, refrigerant pressurized by the compressor 101 is liquefied by the condenser 102 and sent to the expansion valve 1. The refrigerant adiabatically expanded by the expansion valve 1 is sent to the evaporator 104, and heat is exchanged by the evaporator 104 with air flowing around the evaporator. The refrigerant returning from the evaporator 104 is returned to the compressor 101 side through the expansion valve 1 (more specifically, the return flow path 23).

The high-pressure refrigerant is supplied from the condenser 102 to the expansion valve 1. More specifically, the high-pressure refrigerant from the condenser 102 is supplied to the valve chamber VS via the first flow path 21. In the valve chamber VS, the valve element 3 is disposed so as to face the valve seat 20. The valve element 3 is supported by a valve element support member 7, and the valve element support member 7 is biased upward by a biasing member 4 (for example, a coil spring). In other words, the valve element 3 is biased in the valve closing direction by the biasing member 4. The biasing member 4 is disposed between the valve element support member 7 and the biasing member receiving member 24. In the example illustrated in FIG. 10, the biasing member receiving member 24 is a plug which is mounted on the valve body 2 to seal the valve chamber VS.

When the valve element 3 is seated on the valve seat 20 (that is, when the expansion valve 1 is in the closed state) the first flow path 21 on the upstream side of the valve chamber VS and the second flow path 22 on the downstream side of the valve chamber VS are in a non-communicative state. On the other hand, when the valve element 3 is separated from the valve seat 20 (in other words, when the expansion valve 1 is in the open state), the refrigerant supplied to the valve chamber VS is delivered to the evaporator 104 through the second flow path 22. It should be noted that the switching between the closed state and the open state of the expansion valve 1 is performed by the actuation rod 5 connected to the power element 8.

In the example illustrated in FIG. 10, the power element 8 is arranged at the upper end of the expansion valve 1. The power element 8 includes a top cover member 81, a receiving member 82 having an opening at its center, and a diaphragm disposed between the top cover member 81 and the receiving member 82. The first space surrounded by the top cover member 81 and the diaphragm is filled with a working gas.

The lower surface of the diaphragm is connected to the actuation rod via a diaphragm support member. Therefore, when the working gas in the first space is liquefied, the actuation rod 5 moves upward, and when the liquefied working gas is vaporized, the actuation rod 5 moves downward. In this manner, the expansion valve 1 is switched between the open state and the closed state.

The second space between the diaphragm and the receiving member 82 communicates with the return flow path 23. Accordingly, the phase of the working gas in the first space (gas phase, liquid phase, etc.) changes in accordance with the temperature and pressure of the refrigerant flowing through the return flow path 23, and the actuation rod 5 is driven.

In other words, in the expansion valve 1 illustrated in FIG. 10, the amount of the refrigerant supplied from the expansion valve 1 to the evaporator 104 is automatically adjusted in accordance with the temperature and pressure of the refrigerant returned from the evaporator 104 to the expansion valve 1.

It should be noted that the expansion valve 1 applied to the refrigerant circulation system 100 may be the expansion valve 1A of the first embodiment, the expansion valve 1B of the second embodiment, or the expansion valve 1C of the third embodiment.

The present invention is not limited to the embodiments described above. Within the scope of the present invention, any combination of the above-described embodiments is possible, and variations of any component of the embodiments are possible. In addition, any component can be added or omitted in each embodiment.

REFERENCE SIGNS LIST

1, 1A, 1B, 1C: Expansion valve
2: Valve body
3: Valve element
4: Biasing member
5: Actuation rod
6: Vibration isolating spring
7: Valve element support member
8: Power element
20: Valve seat
21: First flow path
22: Second flow path
23: Return flow path
24: Biasing member receiving member
25: Leg portion guide inner wall surface
27: Actuation rod insertion hole
27*a*: Inner wall surface
60, 60A, 60B, 60C: Leg spring
61: Base portion

63: Leg portion
63*a*: Elastic portion
63*b*: Tip side protrusion portion
81: Top cover member
82: Receiving member
100: Refrigerant circulation system
101: Compressor
102: Condenser
104: Evaporator
AX1: Center axis of leg spring
AX2: Center axis of actuation rod insertion hole
AX3: Center axis of leg portion guide inner wall surface center axis
C: Center
VS: Valve chamber

The invention claimed is:

1. An expansion valve comprising: a valve body including a valve chamber; a valve element disposed in the valve chamber; a biasing member configured to bias the valve element toward a valve seat; an actuation rod that comes into contact with the valve element and presses the valve element in a valve opening direction against a biasing force of the biasing member; and a vibration isolating spring configured to suppress vibration of the valve element, wherein: the actuation rod is inserted into an actuation rod insertion hole provided in the valve body, the vibration isolating spring includes a leg spring having a base portion and a plurality of leg portions extending from the base portion, and the leg spring is arranged in the valve chamber such that a center axis of the leg spring is non-coincident with a center axis of the actuation rod insertion hole when the valve is in an open position in which the valve element is separated from the valve opening, the plurality of leg portions include at least a first leg portion and a second leg portion; a first contact portion that contacts the valve body is provided at a tip portion of the first leg portion; a second contact portion that contacts the valve body is provided at a tip portion of the second leg portion; and the first contact portion and the second contact portion differ from each other in size or protrusion height.

2. The expansion valve according to claim 1, wherein:
the valve body includes a leg portion guide inner wall surface that the plurality of leg portions come into contact therewith; and
a center axis of the leg portion guide inner wall surface is eccentric with respect to the center axis of the actuation rod insertion hole.

3. The expansion valve according to claim 1, wherein:
the plurality of leg portions includes three or more leg portions;
the three or more leg portions are equally spaced around the center axis of the leg spring; and
a shape of elastic portions of the plurality of leg portions are all identical.

4. The expansion valve according to claim 1, wherein:
the plurality of leg portions are unequally spaced around the center axis of the leg spring.

5. The expansion valve according to claim 4, wherein:
an elasticity modulus of the first leg portion and an elasticity modulus of the second leg portion are different from each other.

* * * * *